US010682855B2

(12) United States Patent
Uchida et al.

(10) Patent No.: US 10,682,855 B2
(45) Date of Patent: Jun. 16, 2020

(54) LIQUID EJECTING HEAD

(71) Applicant: SEIKO EPSON CORPORATION, Tokyo (JP)

(72) Inventors: Kazuaki Uchida, Fujimi-machi (JP); Toshiro Murayama, Fujimi-machi (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/358,996

(22) Filed: Mar. 20, 2019

(65) Prior Publication Data

US 2019/0291434 A1 Sep. 26, 2019

(30) Foreign Application Priority Data

Mar. 23, 2018 (JP) ..... 2018-056079

(51) Int. Cl.
*B41J 2/14* (2006.01)

(52) U.S. Cl.
CPC ..... *B41J 2/14274* (2013.01); *B41J 2/1433* (2013.01)

(58) Field of Classification Search
CPC .. B41J 2/14274; B41J 2/1433; B41J 2/14233; B41J 2/14201
See application file for complete search history.

(56) References Cited

U.S. PATENT DOCUMENTS

| | | | | |
|---|---|---|---|---|
| 2010/0214334 | A1* | 8/2010 | Kusunoki et al. | 347/9 |
| 2012/0176450 | A1 | 7/2012 | Akahane et al. | |
| 2012/0242750 | A1 | 9/2012 | Akahane | |
| 2015/0054887 | A1 | 2/2015 | Watanabe et al. | |
| 2018/0194134 | A1* | 7/2018 | Kawakubo et al. | B41J 2/145 |

FOREIGN PATENT DOCUMENTS

| | | | |
|---|---|---|---|
| JP | 2012-143948 | A | 8/2012 |
| JP | 2012-196882 | A | 10/2012 |
| JP | 2015-039794 | A | 3/2015 |

* cited by examiner

*Primary Examiner* — Juanita D Jackson
(74) *Attorney, Agent, or Firm* — Workman Nydegger

(57) ABSTRACT

A liquid ejecting head has: a nozzle plate defining a nozzle; a pressure generating section corresponding to a pressure chamber communicating with the nozzle and the section configured to cause a liquid to be ejected from the nozzle; a common flow path through which the liquid is to be supplied to and discharged from the pressure chamber; and a vibration absorbing body configured to eliminate changes in pressure in the common flow path. The vibration absorbing body and the nozzle plate each define an inner wall of the common flow path and an outer wall of the liquid ejecting head.

20 Claims, 7 Drawing Sheets

LIQUID EJECTING HEAD

BACKGROUND

1. Technical Field

The present invention relates to a liquid ejecting head.

2. Related Art

A head that ejects a liquid such as an ink from a nozzle has a pressure generating section that generates pressure at part of a flow path through which the ink is supplied to the nozzle. The head ejects the liquid from the nozzle under the generated pressure. In this case, a compliance section is provided at part of the flow path to quickly attenuate residual vibration caused in the flow path due to the pressure generated from the pressure generating section (see JP-A-2015-039794, for example).

Recently, various countermeasures are taken to suppress nozzle clogging caused by, for example, an increase in liquid viscosity or foreign matter mixed into the nozzle. In an example of a proposed solution to the problem of an increase in liquid viscosity and nozzle clogging, ink in a communication path provided between the pressure generating section and the nozzle is circulated.

As for this type of liquid ejecting head that circulates a liquid, it cannot be said that an adequate study has been made for the way that variations in pressure generated in the pressure generating section affect various portions in the flow path. The inverters made a study about a preferable structure of a vibration absorbing body, which is a compliance section that attenuates residual vibration, without enlarging the apparatus.

SUMMARY

According to an aspect of the invention, a liquid ejecting head that ejects a liquid to the outside is provided. This liquid ejecting head has: a nozzle plate on which nozzles that eject the liquid are formed; a pressure generating section that causes the liquid to be ejected from the nozzles, the pressure generating section being disposed in a pressure chamber communicating with a communication path in which the nozzles are placed; a common flow path through which the liquid is supplied to and discharged from the communication path and pressure chamber; a flow mechanism that moves the liquid supplied to and discharged from the common flow path so as to pass through a flow path that includes the pressure chamber and communication path; and a vibration absorbing body in a planar form that eliminates changes in pressure in the common flow path. The vibration absorbing body is placed at a position at which one surface of the vibration absorbing body forms part of an inner wall of the common flow path and another surface of the vibration absorbing body forms part of an outer wall of the liquid ejecting head. The nozzle plate is placed at a position at which one surface of the nozzle plate forms part of an inner wall of the common flow path at a position different from the position at which the vibration absorbing body is placed and another surface of the nozzle plate forms part of an outer wall of the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
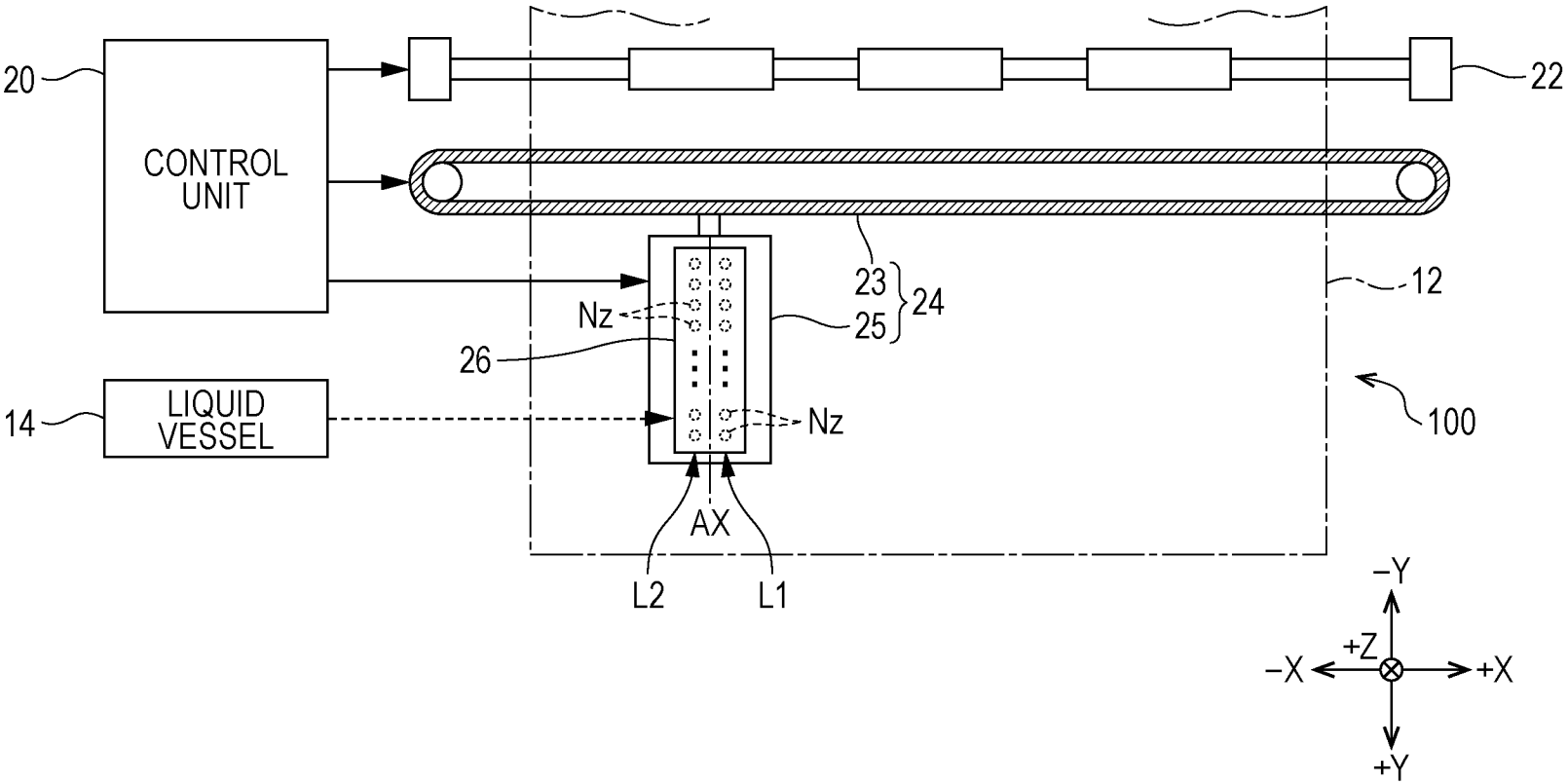
FIG. 1 schematically illustrates the structure of a liquid ejecting apparatus in a first embodiment.

FIG. 1 schematically illustrates the structure of a liquid ejecting apparatus 100 in an embodiment of the invention. The liquid ejecting apparatus 100 is an ink jet printer that ejects an ink, which is an example of a liquid, to a medium 12. The liquid ejecting apparatus 100 handles not only a print sheet but also a print target of any material such as a resin film or a cloth as the medium 12, and performs printing on media 12 of these types. In FIG. 1 and subsequent drawings, the X direction is the transport direction (main scanning direction) of a liquid ejecting head 26, which will be described later, the Y direction is a medium feeding direction (sub-scanning direction) orthogonal to the main scanning direction, and the Z direction is an ink ejecting direction orthogonal to an XY plane. When an orientation is to be identified, a positive or negative sign is used together with the indication of the direction.

The liquid ejecting apparatus 100 has a liquid vessel 14, a transporting mechanism 22 that feeds the medium 12, a control unit 20, a head moving mechanism 24, and the liquid ejecting head 26. The liquid vessel 14 individually stores a plurality of types of ink to be ejected from the liquid ejecting head 26. As the liquid vessel 14, a bag-like ink pack made of a flexible film, an ink tank in which ink can be replenished, and the like can be used. The control unit 20, which includes a processing circuit such as a central processing unit (CPU) or a filed programmable gate array (FPGA) and also includes a storage circuit such as a semiconductor memory, controls the transporting mechanism 22, head moving mechanism 24, liquid ejecting head 26, and the like in an overall manner. The transporting mechanism 22, which operates under control of the control unit 20, feeds the medium 12 in the +Y direction.

The head moving mechanism 24 has a transport belt 23 stretched in the X direction across the print range of the medium 12, and also has a carriage 25 that accommodates the liquid ejecting head 26 and secures it to the transport belt 23. The head moving mechanism 24, which operates under control of the control unit 20, bidirectionally moves the carriage 25 in the main scanning direction (X direction) of the liquid ejecting head 26. When the carriage 25 is bidirectionally moved, the carriage 25 is guided by a guide rail (not illustrated). In the head structure, a plurality of liquid ejecting heads 26 may be mounted in the carriage 25 or the liquid vessel 14 may be mounted in the carriage 25 together with the liquid ejecting head 26.

Under control of the control unit 20, the liquid ejecting head 26 ejects inks, which are supplied from the liquid vessel 14, from a plurality of nozzles Nz toward the medium 12. When inks are ejected from the plurality of nozzles Nz during the bidirectional movement of the liquid ejecting head 26, a desired image or the like is printed on the medium 12. The liquid ejecting head 26 has two nozzle strings in each of which a plurality of nozzles Nz are arranged in the sub-scanning direction, the two nozzle strings being separated with a predetermined amount of spacing between them in the main scanning direction, as illustrated in FIG. 1. In the drawing, these two nozzle strings are indicated as a first nozzle string L1 and a second nozzle string L2. Nozzles Nz in the first nozzle string L1 and nozzles Nz in the second nozzle string L2 are aligned to each other in the main scanning direction. In the description below, the center between the first nozzle string L1 and the second nozzle string L2 will be referred to as the central axis. For convenience of explanation, a YZ plane that includes this central axis and extends in the Y direction will be taken as the central plane AX. The alignment of the nozzles Nz in the first nozzle string L1 and the alignment of the nozzles Nz in the second nozzle string L2 may be staggered with respect to each other in the medium feeding direction (Y direction). The first nozzle string L1 and second nozzle string L2 are provided so as to match a plurality of types of ink stored in the liquid vessel 14. Other nozzle strings are not illustrated.

Figure 2:
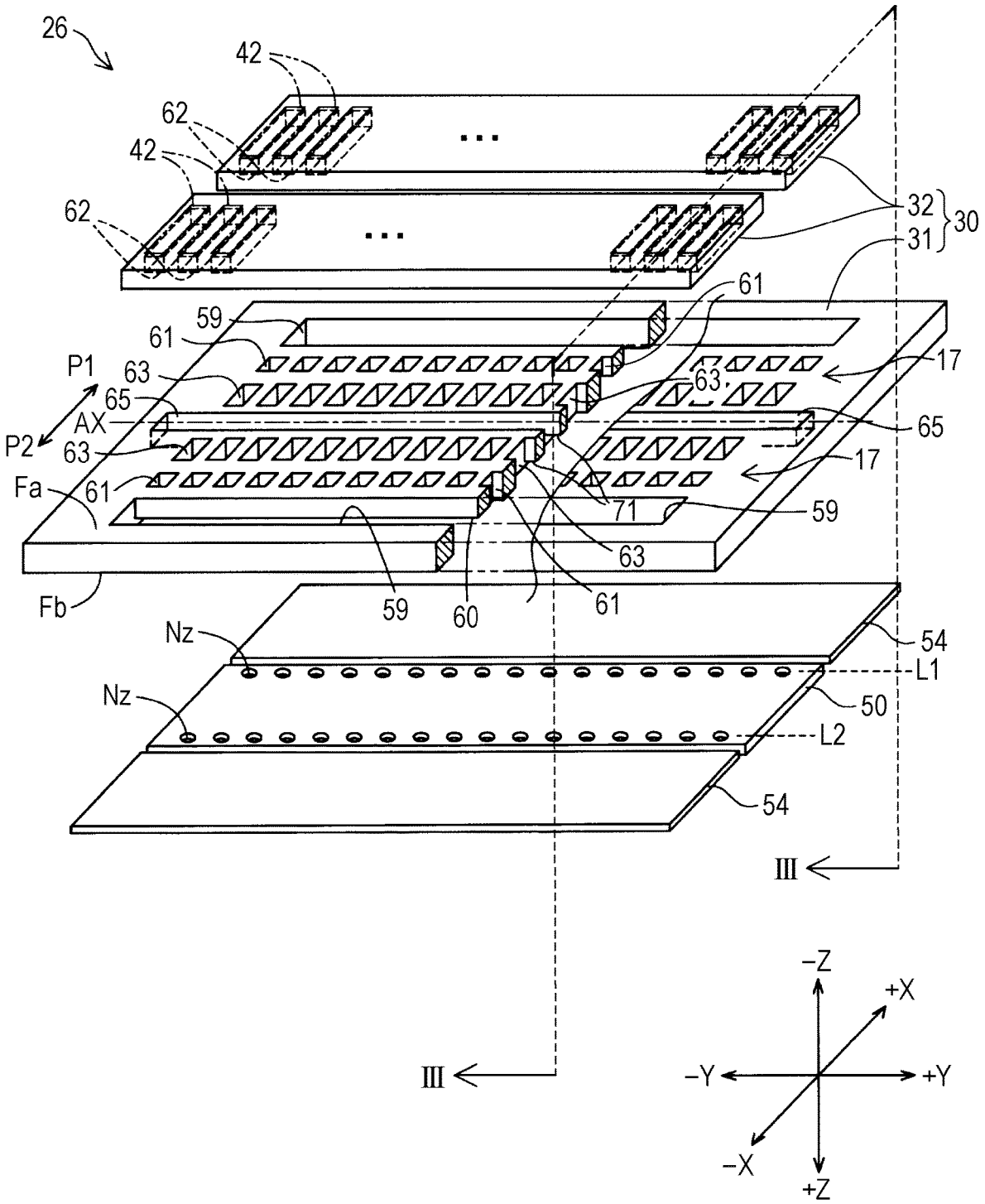
FIG. 2 is an exploded perspective view of the main head constituent members of a liquid ejecting head.
Figure 3:
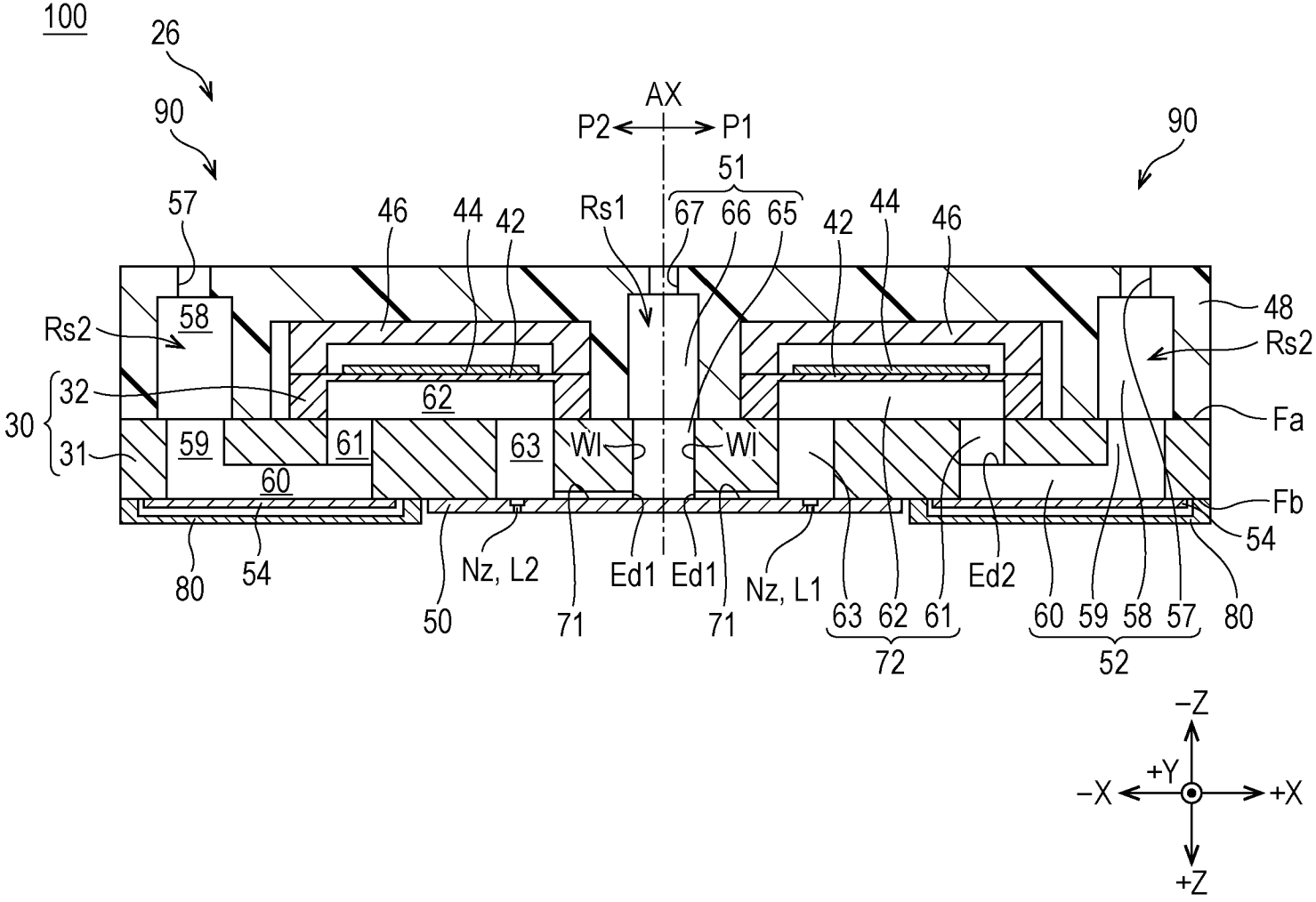
FIG. 3 is a cross-sectional view of the liquid ejecting head as taken along line III-III in FIG. 2.

FIG. 2 is an exploded perspective view of the main head constituent members of the liquid ejecting head 26. The liquid ejecting head 26 having the first nozzle string L1 and second nozzle string L2 is a laminated body in which head constituting members are laminated. In FIG. 2, part of a first flow path substrate 31, which is a constituent member, is broken for convenience of understanding. FIG. 3 is a cross-sectional view taken along line III-III in FIG. 2. For easy understanding of the position, in FIG. 3, at which the first flow path substrate 31 is broken, FIG. 4, which will be referenced later, also illustrates a broken plane taken along line III-III. The structure of the liquid ejecting head 26 will be described below with reference to FIGS. 2 and 3 at appropriate points. In FIGS. 2 and 3, the thicknesses of the illustrated constituent members do not indicate the thicknesses of the actual constituent members.

As illustrated in FIGS. 2 and 3, the liquid ejecting head 26 is structured so that a case 48, second flow path substrates 32, and a first flow path 31 are laminated in that order when viewed from above in the −Z direction, the second flow path substrates 32 and first flow path substrate 31 constituting a flow path forming member 30, and that a nozzle plate 50 and vibration absorbing bodies 54 are attached to the lower surface Fb of the first flow path substrate 31 in the Z direction at positions at which they do not overlap one another. The case 48, which is formed by injection molding of a resin material, is a member that covers the outer surfaces of the first flow path substrate 31 and a protective member 46. For easy understanding of the technology, the case 48 is not illustrated in FIG. 2.

The liquid ejecting head 26 in this embodiment has a structure related to the nozzles Nz in the first nozzle string L1, a structure related to the nozzles Nz in the second nozzle string L2, and flow paths connected to the nozzles Nz so as to be symmetric with respect to the central plane AX. That is, in the liquid ejecting head 26, a first portion P1 on the +X side and a second portion P2 on the −X side with respect to the central plane AX have the same structure. The nozzles Nz in the first nozzle string L1 belong to the first portion P1 and the nozzles Nz in the second nozzle string L2 belong to the second portion P2. The central plane AX is a boundary face between the first portion P1 and the second portion P2.

The flow path forming member 30 is formed by laminating two second flow path substrates 32 placed side by side in the X direction on the first flow path substrate 31. The first flow path substrate 31 and second flow path substrate 32 are each a plate elongated in the Y direction. Liquid flow paths are formed by combining openings and grooves formed in the first flow path substrate 31 and second flow path substrates 32. When the nozzle plate 50 and vibration absorbing bodies 54 are attached to the lower surface Fb of the first flow path substrate 31, grooves formed in the lower surface Fb of the first flow path substrate 31 form flow paths between the nozzle plate 50 and the lower surface Fb and between the vibration absorbing bodies 54 and the lower surface Fb.

The first flow path substrate 31 has second flow-in chambers 59, to-be-supplied liquid chambers 60, supply paths 61, communication paths 63, first individual flow paths 71, and a first flow-in chamber 65. The first flow-in chamber 65, which is an opening the longitudinal direction of which is the Y direction, is formed so as to extend in the Y direction at the center of the first flow path substrate 31 in the X direction. The second flow-in chambers 59, each of which is an opening the longitudinal direction of which is the Y direction, are formed so as to extend in the Y direction at both ends of the first flow path substrate 31 in the X direction, one at each end. In the lower surface Fb of the first flow path substrate 31, grooves led to each communication path 63 are formed on both sides of the first flow-in chamber 65 as the first individual flow paths 71, one at each end.

Furthermore, a region, on the lower surface Fb of the first flow path substrate 31, that extends from the second flow-in chamber 59 toward the center of the first flow path substrate 31 in the X direction is formed so as to extend from the lower surface Fb of the whole of the first flow path substrate 31 in the −Z direction, as the to-be-supplied liquid chamber 60. The second flow-in chamber 59 and to-be-supplied liquid chamber 60 form a second common flow path 52 together with other constituent members disposed in the case 48. The first flow-in chamber 65 forms a first common flow path 51 together with other constituent members that area also disposed in the case 48. The structures of the first common flow path 51 and second common flow path 52 will be described later in detail.

As many communication paths 63 and supply paths 61 as there are nozzles Nz at positions between the first flow-in chamber 65 and the second flow-in chamber 59. These communication paths 63 and supply paths 61 are each an angular opening formed in the first flow path substrate 31. The communication path 63 and supply path 61 form a second individual flow path 72 together with a pressure chamber 62 formed in the second flow path substrate 32. The structure of the second individual flow path 72 and its function will be described later in detail together with those of the first individual flow path 71.

The two second flow path substrates 32 are secured to the upper surface Fa of the first flow path substrate 31 in the −Z direction with an adhesive. One of the two second flow path substrates 32 is placed in the first portion P1 on the upper surface Fa of the first flow path substrate 31, and the other is placed in the second portion P2 on the upper surface Fa. A plurality of rectangular grooves are formed in the lower surface of each second flow path substrate 32. When each second flow path substrate 32 is bonded to the first portion P1 or second portion P2, whichever is appropriate, on the first flow path substrate 31, each groove forms the pressure chamber 62 together with the upper surface Fa of the first flow path substrate 31. The outer shape of each pressure chamber 62 in each second flow path substrate 32 in the +Z direction includes the outer shapes, in the −Z direction, of the relevant supply path 61 and communication path 63 in the first flow path substrate 31. Thus, the pressure chamber 62, supply path 61, and communication path 63 are connected together, forming the second individual flow path 72.

On the upper surface of the second flow path substrate 32, a piezoelectric element 44 is attached to a region, (surface in the −Z direction) that faces one pressure chamber 62, forming a vibrating section 42. The depth of a groove forming the pressure chamber 62 is slightly smaller than the thickness of the second flow path substrate 32. That is, at the region of the pressure chamber 62, the second flow path substrate 32 is thin, so it is a wall surface that can be deformed in response to the distortion of the piezoelectric element 44.

The nozzle plate 50 attached to the lower surface Fb of the first flow path substrate 31 is a member in a planar form that has a plurality of nozzles Nz. The nozzle plate 50 is formed from a monocrystalline substrate of silicon (Si). The nozzle Nz is formed by, for example, a processing technology such as dry etching or wet etching.

The nozzle Nz is a though-hole used to eject an ink to the outside. In this embodiment, an ink is ejected from the nozzle Nz in the Z direction. The plurality of nozzle Nz are divided into the first nozzle string L1 and second nozzle string L2, which are linearly placed.

The wall surface of the nozzle plate 50 in the −Z direction is attached to the lower surface Fb of the first flow path substrate 31 so that each nozzle Nz is positioned immediately underneath the relevant communication path 63 (in the Z direction). In this case, the wall surface of the nozzle plate 50 in the −Z direction other than the nozzles Nz covers the first flow-in chambers 65, communication paths 63, and first individual flow paths 71 in the first flow path substrate 31, each first individual flow path 71 being formed as a groove between the first flow-in chamber 65 and the communication path 63. Therefore, the nozzle plate 50 works as an inner wall of the flow path at the regions of the first flow-in chamber 65, first individual flow path 71, and communication path 63 in the first flow path substrate 31. The surface of the nozzle plate 50 in the +Z direction works as an outer wall of the liquid ejecting head 26.

As illustrated, the two vibration absorbing bodies 54 placed at both ends of the nozzle plate 50 in the X direction are each a flexible film in a planner form. The vibration absorbing body 54 is formed from, for example, a compliance substrate. The surfaces of the vibration absorbing bodies 54 in the −Z direction are attached to the first portion P1 and second portion P2 on the lower surface Fb of the first flow path substrate 31 with an adhesive, one surface to each portion. In this case, each vibration absorbing body 54 is placed so as to cover the to-be-supplied liquid chamber 60 and second flow-in chamber 59 in the first flow path substrate 31. Thus, the surface of the vibration absorbing body 54 in the −Z direction works as the inner walls of flow paths in the regions of the to-be-supplied liquid chamber 60 and second flow-in chamber 59. The surface of each vibration absorbing body 54 in the +Z direction works as an outer wall of the liquid ejecting head 26. Working as an external surface of the liquid ejecting head 26 indicates that the nozzle plate 50 and vibration absorbing bodies 54 form at least part of the practical outer wall surfaces of the liquid ejecting head 26. Therefore, even if a coating or film is formed on the surface of the nozzle plate 50 in the +Z direction except the region of the nozzles Nz or a cover is provided on the nozzle plate 50 except the region of the nozzles Nz, it can be said that the nozzle plate 50 works as an outer wall of the liquid ejecting head 26. Similarly, even if a coating or film is formed on the surface of the vibration absorbing body 54 in the +Z direction or a cover is provided on the vibration absorbing body 54 so as to cover part or the whole of the vibration absorbing body 54 as in the case of a cover 80, which will be described later, it can be said that the vibration absorbing body 54 works as an outer wall of the liquid ejecting head 26.

Two covers 80 are further provided on the outer walls of the vibration absorbing bodies 54, one for each vibration absorbing body 54. The cover 80 is an elongated plate-like member made of a stainless steel plate (also referred to as a SUS plate). In one surface of the cover 80, an elongated concave section is formed, in which the relevant vibration absorbing body 54 is accepted. The cover 80 is secured to the lower surface Fb of the first flow path substrate 31 so as to cover the vibration absorbing body 54 in the concave section. Thus, the cover 80 protects the vibration absorbing body 54 on the same side as an outer wall of the liquid ejecting head 26. Therefore, the vibration absorbing body 54 is protected by the cover 80 from a contact with an object outside the liquid ejecting head 26. Part of the cover 80 may form part of the outer walls of the liquid ejecting head 26.

As illustrated in FIG. 3, the case 48 is secured to the upper surface Fa, which is in the −Z direction, of the flow path forming member 30 with an adhesive. In the case 48, second liquid chambers 58 having the same shape as the second flow-in chambers 59 are formed at the positions corresponding to the second flow-in chambers 59 formed in the first flow path substrate 31. In each second flow-in chamber 59, a second circulation port 57 is formed at the center in the Y direction. The second liquid chamber 58 and second circulation port 57 form the second common flow path 52 together with the to-be-supplied liquid chamber 60 and second flow-in chamber 59, which have been already described. Thus, when connected to the second flow-in chamber 59, the second liquid chamber 58 forms one space and functions as an ink retaining chamber (reservoir Rs2), forming a common flow path through which an ink is supplied to and discharged from the communication path 63 and pressure chamber 62 in common.

At the center of the case 48 in the X direction, a first liquid chamber 66, which is a groove having the same shape as the first flow-in chamber 65, is formed at the position corresponding to the first flow-in chamber 65. First circulation ports 67, each of which is a through-hole, are formed at both ends of the first liquid chamber 66 in the Y direction, one at each end. The first liquid chamber 66 and first circulation ports 67 form the first common flow path 51 together with the first flow-in chamber 65, which has been already described. The first liquid chamber 66 and first flow-in chamber 65 form an ink retaining chamber (reservoir Rs1), forming a common flow path through which an ink is supplied to and discharged from the communication path 63 and pressure chamber 62 in common.

In the case 48, grooves having the same shape as the second flow path substrates 32 are also formed at the positions corresponding to the second flow path substrates 32. In each of these grooves, the protective member 46, which protects the second flow path substrate 32 and the piezoelectric element 44 attached to the upper surface of the second flow path substrate 32, is accommodated.

The structure of the liquid ejecting head 26 described above will be summarized below. At the center of the liquid ejecting head 26 in the X direction, the first common flow path 51 is formed in the Y direction. Second common flow paths 52 are formed in the Y direction at both ends of the liquid ejecting head 26 in the X direction, one at each end. On both sides of the communication path 63 in which the nozzle Nz is present, the first individual flow path 71 is present between the communication path 63 and the first common flow path 51 and the second individual flow path 72 is present between the communication path 63 and the second common flow path 52. Therefore, if a portion from the first common flow path 51 to the second common flow path 52 is filled with a liquid, when a fluid enters the liquid ejecting head 26 from the first circulation port 67 of the first common flow path 51, the fluid flows from the first common flow path 51, which is a common flow path, through a plurality of first individual flow paths 71 to communication paths 63, each of which is an individual path, after which the fluid further passes through a plurality of second individual flow paths 72 and joins again at the second common flow path 52, which is a common flow path. If a fluid enters the liquid ejecting head 26 from the second circulation port 57 of the second common flow path 52, the fluid flows in the opposite direction. Thus, the liquid ejecting head 26 in this embodiment has a structure that is symmetric with respect to the central plane AX illustrated in FIG. 1. Flow paths from the first common flow path 51 to each second common flow path 52 will be collectively referred to as a circulating flow path 90.

In liquid ejecting head 26 in this embodiment, for one first common flow path 51, a plurality of individual flow paths 70 and one second common flow path 52 are provided on the first portion P1 and a plurality of individual flow paths 70 and one second common flow path 52 are provided on the second portion P2. A plurality of individual flow paths 70 in one circulating flow path 90 will also be referred to as an individual flow path group 17. The liquid ejecting head 26 in this embodiment has the individual flow path group 17 in both the first portion P1 and the second portion P2. That is, in the liquid ejecting head 26 in this embodiment, one first common flow path 51 and two second common flow paths 52 are connected together by two individual flow path groups 17, forming two circulating flow paths 90. Thus, in the liquid ejecting head 26 in this embodiment, a plurality of circulating flow paths 90 are provided to increase the number of nozzles Nz provided in one liquid ejecting head 26.

FIG. 3 schematically illustrates a wall surface Wl, which is an inner wall of the first flow-in chamber 65 in the first common flow path 51. The wall surface Wl is one, of the wall surfaces of the first common flow path 51, that extends in the Z direction, in which the ink in the first common flow path 51 flows, the wall surface Wl being at a location closer to the nozzles Nz (the side in the X direction in FIG. 3) than is the first common flow path 51. In this embodiment, each first individual flow path 71 and the first common flow path 51 are connected directly to the first common flow path 51 on a wall surface at a position Ed1, which is an end of the nozzle plate 50 on the same side as the inner wall, the wall surface being part of the wall surface Wl of the first common flow path 51. This direct connection to the first common flow path 51 at the position Ed1 represents a state in which an opening is formed for the first common flow path 51 at the position Ed1 on the wall surface Wl (that is, the wall surface Wl and the plane of this opening are flush with each other). This makes it easy to evenly supply the ink in the first common flow path 51 to a plurality of individual flow paths 70 when compared with, for example, an aspect in which each first individual flow path 71 and the first common flow path 51 are connected together at a position distant from the wall surface Wl of the first common flow path 51 toward the nozzle Nz.

In FIG. 3, positions Ed2, at each of which one supply path 61 and the to-be-supplied liquid chamber 60 are connected together, are indicated. This position Ed2, at which one supply path 61 and the to-be-supplied liquid chamber 60 are connected together, is at a predetermined distance from the vibration absorbing body 54. In this embodiment, one supply path 61 and the to-be-supplied liquid chamber 60 are connected together at the position Ed2 on a plane along the wall surface, of the to-be-supplied liquid chamber 60, that faces the vibration absorbing body 54.

The piezoelectric element 44 is an active element that is deformed in response to a driving signal from the control unit 20. The piezoelectric element 44 generates vibration due to this deformation. Vibration caused by the piezoelectric element 44 is transmitted to the vibrating section 42, causing a change in the pressure of the ink in the pressure chamber 62. Thus, the vibrating section 42 having the piezoelectric element 44 functions as a pressure generating section that changes the pressure of the liquid in the pressure chamber 62, which is provided for each of the nozzles Nz in the first nozzle string L1 and second nozzle string L2. This change in pressure passes through the communication path 63, reaches the nozzle Nz, and ejects the ink from the nozzle Nz.

Flow of the ink in the liquid ejecting head 26 in this embodiment will be described. In this embodiment, ink is supplied from the first circulation port 67 to the liquid ejecting head 26. The ink supplied from the first circulation port 67 passes through the first liquid chamber 66 and reaches the first flow-in chamber 65. After the arrival at the first flow-in chamber 65, the ink comes into contact with the inner wall of the nozzle plate 50 and flows in the planar direction of the nozzle plate 50. At that time, while proceeding in the Y direction, the ink is distributed to the first individual flow paths 71 of the individual flow path groups 17 in the first portion P1 and second portion P2.

After the ink flows into each first individual flow path 71, the ink flows in the planar direction of the nozzle plate 50 and is supplied to the communication path 63 of the second individual flow path 72. After the ink flows into the communication path 63, the ink is led to the pressure chamber 62 connected to the communication path 63. When vibration caused by the piezoelectric element 44 is transmitted to the ink, the ink in the communication path 63 is ejected from the nozzle Nz toward the outside.

The ink that has flowed into the pressure chamber 62 is led to the supply path 61. The ink discharged from the supply paths 61 in the individual flow path group 17 joins at the to-be-supplied liquid chamber 60 in the second common flow path 52. The ink in the to-be-supplied liquid chamber 60 is led to the second flow-in chamber 59 along the wall surface of the vibration absorbing body 54. After the ink flows into the second flow-in chamber 59, the ink flows into the second liquid chamber 58 and is discharged from the second circulation port 57 into an ink storage tank 76, which will be described later.

As described above, in the liquid ejecting head 26 in this embodiment, ink supplied to the first common flow path 51 passes through each first individual flow path 71 and its relevant second individual flow paths 72 and is supplied to the relevant second common flow path 52. That is, the first common flow path 51 is on the upstream side of the ink flow paths in this embodiment, and the second common flow path 52 is on the downstream side of the ink flow paths. The internal pressure of the flow paths on the downstream side suffers from a pressure loss due to flow path resistance in the first individual flow paths 71 and second individual flow paths 72. Therefore, the internal pressure in the flow paths on the downstream side is lower than the internal pressure in the flow paths on the upstream side.

In the liquid ejecting head 26 in this embodiment, one surface of the vibration absorbing body 54 forms an inner wall of the circulating flow path 90 at a location at which the circulating flow path 90 has internal pressure lower than the internal pressure in the communication path 63 when an ink is circulated in the circulating flow path 90. That is, the vibration absorbing body 54 forms an inner wall located downstream of the communication path 63. One surface of the nozzle plate 50 forms an inner wall of the circulating flow path 90 at a location at which the circulating flow path 90 has internal pressure higher than the internal pressure in the communication path 63 when an ink is circulated in the circulating flow path 90. That is, the nozzle plate 50 forms an inner wall located upstream of the communication path 63. Accordingly, it is possible to restrain the vibration absorbing body 54 from being deformed toward the outside of the liquid ejecting head 26 and thereby to downsize the apparatus when compared with an aspect in which, in the circulating flow path 90, the vibration absorbing body 54 is disposed upstream of the communication path 63.

In addition, in the liquid ejecting head 26 in this embodiment, one surface of the vibration absorbing body 54 forms an inner wall of the circulating flow path 90 at a location at which the circulating flow path 90 has internal pressure lower than the barometric pressure on the same side as the outer wall of the nozzle plate 50 when ink is circulated in circulating flow paths 90. The barometric pressure on the same side as the wall of the nozzle plate 50 is the barometric pressure outside the nozzle plate 50. The barometric pressure may be set by using a constant. In this embodiment, the barometric pressure on the same side as the outer wall of the nozzle plate 50 is set at a constant of 1 atm. In the liquid ejecting head 26, therefore, the vibration absorbing body 54 forms a wall surface of a circulating flow path 90 at a location at which the circulating flow path 90 has internal pressure lower than the barometric pressure outside the liquid ejecting head 26. This makes it easy for the vibration absorbing body 54 to deform toward the interior of the circulating flow path 90, making it possible to suppress the problem that the vibration absorbing body 54 and cover 80 come into contact with each other.

Figure 4:
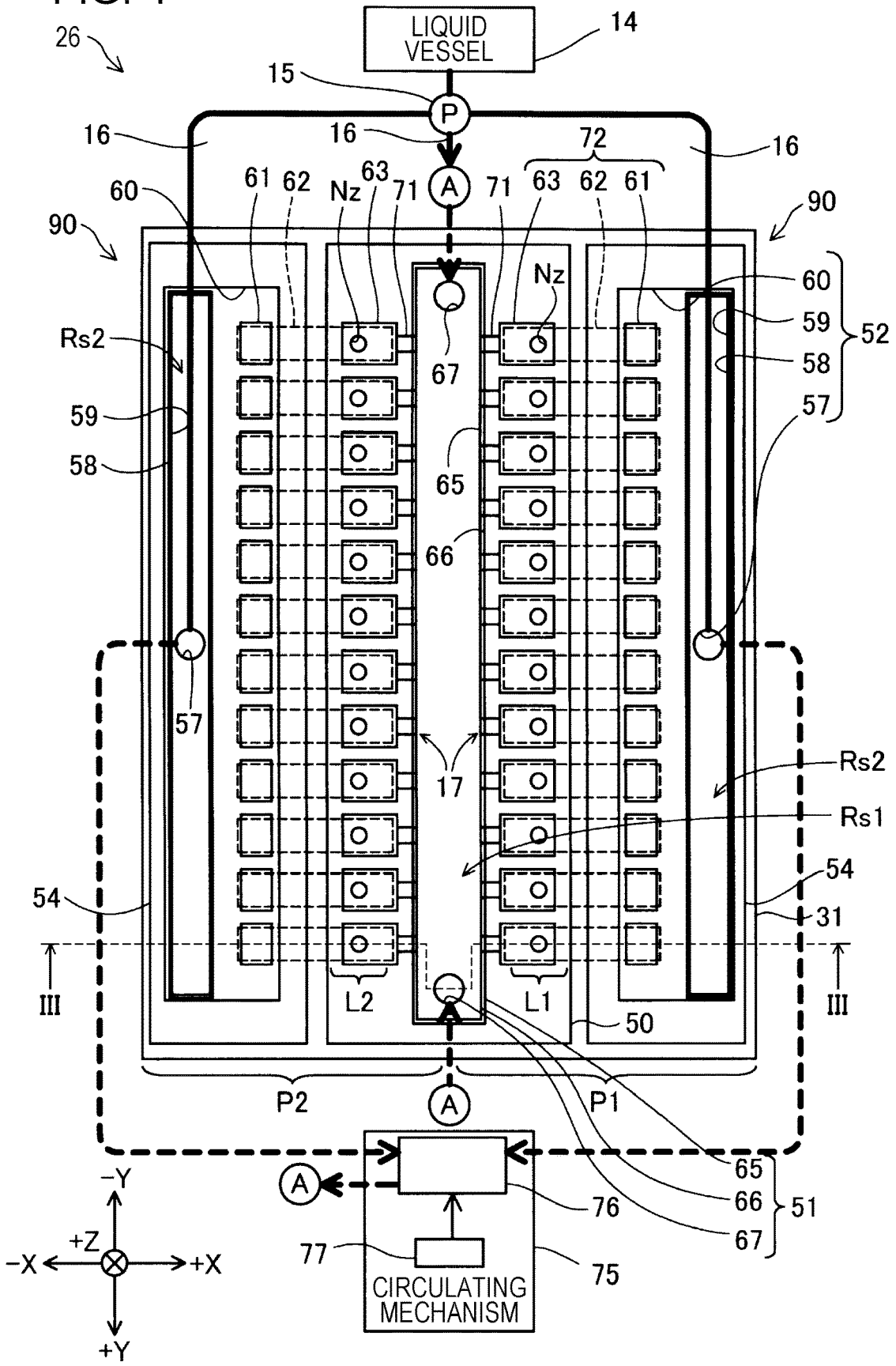
FIG. 4 schematically illustrates ink paths in a plan view of the liquid ejecting head.

FIG. 4 schematically illustrates ink paths in a plan view of the liquid ejecting head 26. For easy understanding of the technology, members that would not be visible due to members located on the front side (Z direction) of the drawing sheet are also illustrated in FIG. 4.

As described above, the liquid ejecting head 26 in this embodiment has two circulating flow paths 90, each of which includes the first common flow path 51, the second common flow path 52, first individual flow paths 71, and second individual flow paths 72, at both ends centered at the central plane AX, one at each end. The liquid ejecting head 26 further has the liquid vessel 14, a pump 15, and supply pipes 16, a circulating mechanism 75, the ink storage tank 76, and a pressure adjusting section 77.

The liquid vessel 14 is a tank that stores ink. The liquid vessel 14 is connected to the pump 15. Each supply pipe 16 is a pipe used to supply ink supplied from the liquid vessel 14 to the circulating flow paths 90. In this embodiment, four supply pipes 16 are provided, which are connected to the two first circulation ports 67 and the two second circulation ports 57.

The ink stored in the liquid vessel 14 is fed under pressure through the interior of the supply pipes 16 by the pump 15. The ink fed under pressure is selectively supplied to the second circulation ports 57 or first circulation ports 67 according to the direction in which the ink in the circulating flow paths 90 flows. In this embodiment, the ink stored in the liquid vessel 14 is supplied to the first circulation ports 67.

The circulating mechanism 75 is a flow mechanism that moves the ink supplied to or discharged from the second circulation ports 57 or first circulation ports 67 so as to pass through the circulating flow paths 90. The circulating mechanism 75 has the ink storage tank 76 and pressure adjusting section 77. The pressure adjusting section 77 adjusts the pressure of the ink in the ink storage tank 76 so as to be lower than pressure under which the pump 15 feeds the ink. Ink circulation in each circulating flow path 90 is implemented by pressure adjustment by the pump 15 and pressure adjusting section 77.

The arrows indicated in FIG. 4 schematically represent directions, in this embodiment, in which ink flows. More specifically, the ink stored in the liquid vessel 14 and the ink stored in the ink storage tank 76 are fed under pressure to the first circulation ports 67 in the first common flow path 51. The ink supplied to the first common flow path 51 is distributed to the first individual flow paths 71 in the first portion P1 and second portion P2 disposed at both ends of the first flow-in chamber 65 in the X direction, one at each end. The ink supplied to each first individual flow path 71 is supplied to the second individual flow path 72 connected to the first individual flow path 71. The ink supplied to the second individual flow path 72 is ejected from the nozzle Nz to the outside or is supplied to the second common flow path 52 connected to the second individual flow path 72. The ink supplied to the second common flow path 52 is fed under pressure to the ink storage tank 76 through the second circulation port 57.

That is, in the liquid ejecting head 26 in this embodiment, ink supplied to the first common flow path 51 is distributed to the first individual flow paths 71 in the first portion P1 and second portion P2, after which the distributed ink passes through the relevant second common flow path 52 and reaches the circulating mechanism 75. The ink that has reached the circulating mechanism 75 is supplied to the first common flow path 51 again. As described above, the liquid ejecting head 26 in this embodiment circulates ink with the two circulating flow paths 90 and the circulating mechanism 75.

So far, the structure of the liquid ejecting head 26 in this embodiment and the flow of ink have been described in detail. In this liquid ejecting head 26, the vibration absorbing bodies 54 and nozzle plate 50 form inner walls of the circulating flow paths 90 and also form outer walls of the liquid ejecting head 26. Therefore, the liquid ejecting head 26 having the circulating flow paths 90 can be structured with less component parts. Therefore, it is possible to implement the liquid ejecting head 26 having the vibration absorbing bodies 54 and nozzle plate 50 without enlarging the apparatus.

B. Second Embodiment

Figure 5:
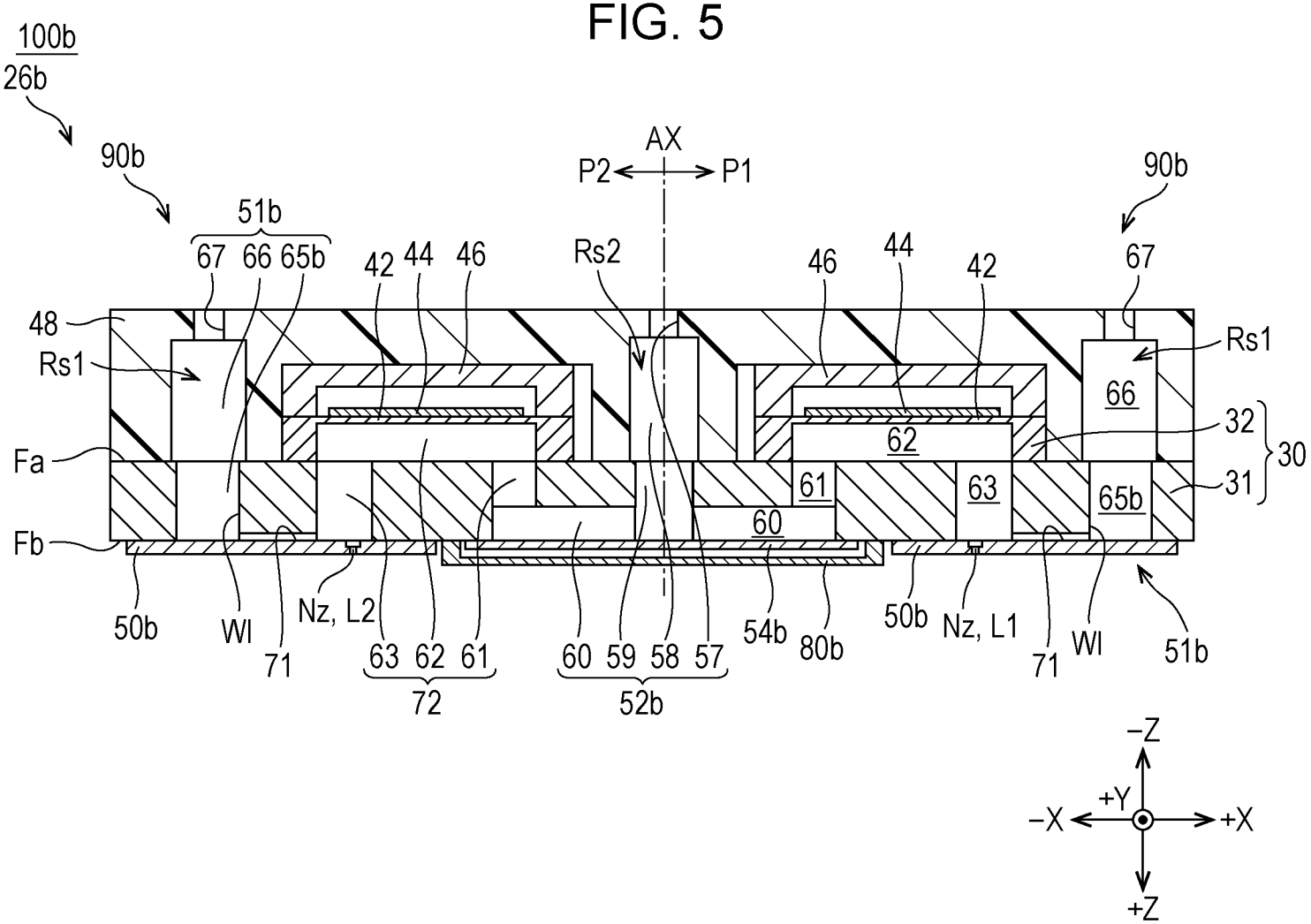
FIG. 5 is a cross-sectional view of a liquid ejecting head included in a liquid ejecting apparatus in a second embodiment.

FIG. 5 is a cross-sectional view of a liquid ejecting head **26*b* included in a liquid ejecting apparatus 100*b* in a second embodiment. The liquid ejecting head 26*b* in the second embodiment differs from the liquid ejecting head 26 in the first embodiment in that the liquid ejecting head 26***b* has circulating flow paths 90*b* instead of the circulating flow paths 90 in the first embodiment, one vibration absorbing body 54*b* instead of two vibration absorbing bodies 54, one cover 80*b* instead of two covers 80, and two nozzle plates 50*b* instead of one nozzle plate 50. Other respects of the liquid ejecting head 26*b* are similar to the relevant aspects of the liquid ejecting head 26 in the first embodiment.

The liquid ejecting head 26*b* has two circulating flow paths 90*b*. The circulating flow path 90*b* differs from the circulating flow path 90 in the first embodiment in that the circulating flow path 90*b* has two first common flow paths 51*b* instead of one first common flow path 51 in the first embodiment and one second common flow path 52*b* instead of two second common flow paths 52 in the first embodiment. Other respects of the circulating flow path 90*b* are similar to the relevant aspects of the circulating flow path 90 in the first embodiment.

For one second common flow path 52*b*, the liquid ejecting head 26*b* has one individual flow path group 17 and one first common flow path 51*b* in the first portion P1 and also has one individual flow path group 17 and one first common flow path 51*b* in the second portion P2. That is, in the liquid ejecting head 26*b* in this embodiment, one second common flow path 52*b* and two first common flow paths 51*b* are connected together with two individual flow path groups 17, forming two circulating flow paths 90*b*. Thus, in the liquid ejecting head 26*b* in this embodiment, a plurality of circulating flow paths 90*b* are provided to increase the number of nozzles Nz provided in one liquid ejecting head 26*b*.

In the liquid ejecting head 26*b*, ink fed under pressure by the pump 15 and circulating mechanism 75 is supplied to the first circulation ports 67 in the first portion P1 and second portion P2 through the supply pipes 16. In each circulating flow path 90*b*, the first common flow path 51*b* is on the upstream side of the ink flow paths and the second common flow path 52*b* is on the downstream side. That is, there is a match between the order of the components constituting the circulating flow path 90*b* through which ink flows in the liquid ejecting head 26*b* in the second embodiment and the order of the components constituting the circulating flow path 90 through which ink flows in the liquid ejecting head 26 in the first embodiment.

The vibration absorbing body 54*b* is placed so as to cover the to-be-supplied liquid chamber 60 and second flow-in chamber 59, which are disposed on the downstream side of the ink flow paths, as in the liquid ejecting head 26 in the first embodiment. The second flow-in chamber 59 in the second common flow path 52*b* in the liquid ejecting head 26*b* is formed at a position along the central plane AX. Therefore, one vibration absorbing body 54*b* is disposed so as to cover the to-be-supplied liquid chambers 60 connected to both ends of the second flow-in chamber 59 in the X direction, one at each end. The cover 80*b* is structured so as to cover the vibration absorbing body 54*b*. Each nozzle plate 50*b* forms inner walls of a first flow-in chamber 65*b*, the first individual flow paths 71, and communication path 63, which are on the upstream side of the ink flow paths.

In the liquid ejecting head 26*b* in this embodiment, the vibration absorbing body 54*b* and nozzle plates 50*b* form inner walls, on the upstream side and downstream side, of the circulating flow paths 90*b* and also form outer walls of the liquid ejecting head 26*b*. Therefore, the liquid ejecting head 26*b* having the circulating flow paths 90*b* can be structured with less component parts. Therefore, it is possible to implement the liquid ejecting head 26*b* having the vibration absorbing body 54*b* and nozzle plates 50*b* without enlarging the apparatus. Since, in this embodiment, two nozzle plates 50*b* are provided separately, it is possible to increase flexibility in the placement of the first nozzle string L1 and second nozzle string L2. Furthermore, only one vibration absorbing body 54*b* and only one cover 80*b* are provided, vibration absorbing performance can be increased and the total number of component parts in the vibration absorbing body 54*b*, cover 80*b*, and nozzle plate 50*b* can be reduced.

C. Third Embodiment

Figure 6:
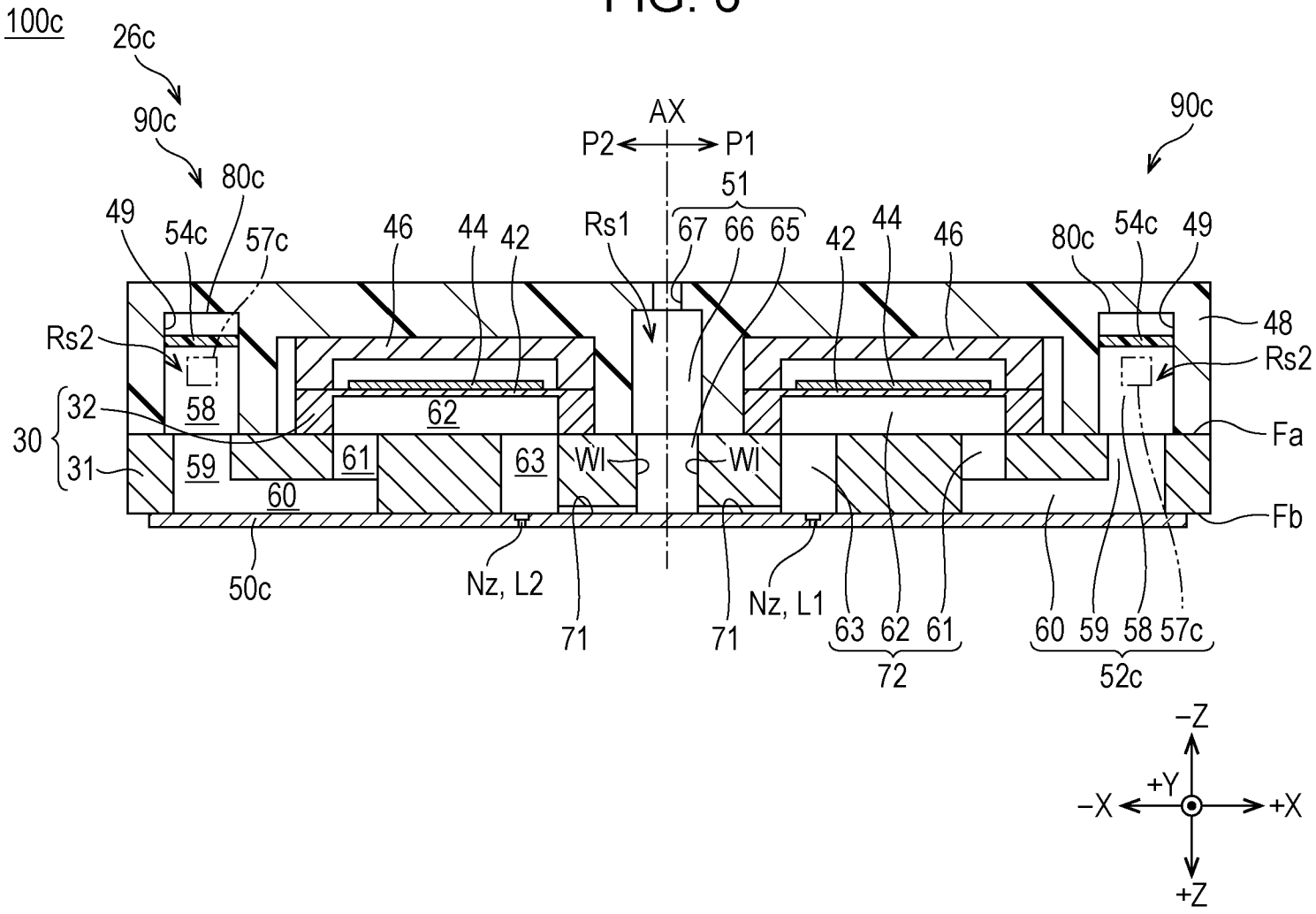
FIG. 6 is a cross-sectional view of a liquid ejecting head included in a liquid ejecting apparatus in a third embodiment.

FIG. 6 is a cross-sectional view of a liquid ejecting head 26*c* included in a liquid ejecting apparatus 100*c* in a third embodiment. The liquid ejecting head 26*c* in the third embodiment differs from the liquid ejecting head 26 in the first embodiment in that the liquid ejecting head 26*c* has a nozzle plate 50*c* instead of the nozzle plate 50 in the first embodiment, circulating flow paths 90*c* instead of the circulating flow paths 90, vibration absorbing bodies 54*c* instead of the vibration absorbing bodies 54, and covers 80*c* instead of the covers 80. Other respects of the liquid ejecting head 26*c* are similar to the relevant aspects of the liquid ejecting head 26 in the first embodiment.

Each nozzle plate 50*c* is a single member in a planar form that covers the lower surface Fb of the first flow path substrate 31. The nozzle plate 50*c* forms an inner wall of the relevant circulating flow path 90*c* and also forms an outer wall of the liquid ejecting head 26*c* in a direction in which the nozzles Nz eject an ink (Z direction). More specifically, the nozzle plates 50*c* in this embodiment form inner walls of the first flow-in chamber 65 and communication paths 63 and also form inner walls of the to-be-supplied liquid chambers 60 and second flow-in chambers 59. Other respects of the nozzle plate 50*c* are similar to the relevant aspects of the nozzle plate 50 in the first embodiment.

The liquid ejecting head 26*c* has two circulating flow paths 90*c*. The circulating flow path 90*c* differs from the circulating flow path 90 in the first embodiment in that the circulating flow path 90*c* has a second circulation port 57*c* in a second common flow path 52*c* instead of the second circulation port 57 in the second common flow path 52. Other respects of the circulating flow path 90*c* are similar to the relevant aspects of the circulating flow path 90 in the first embodiment.

The second circulation port 57*c* is a through-hole formed in a side wall of the second liquid chamber 58. The second circulation port 57*c* differs from the second circulation port 57 in the first embodiment in the position at which the second circulation port 57*c* is formed. Other respects of the second circulation port 57*c* are similar to the relevant aspects of the second circulation port 57 in the first embodiment.

In the liquid ejecting head 26*c*, ink fed under pressure by the pump 15 and circulating mechanism 75 passes through the supply pipes 16 and is supplied to the first circulation ports 67 in the first portion P1 and second portion P2 (see FIG. 4). That is, in each circulating flow path 90*c*, the first common flow path 51 is on the upstream side of the ink flow paths and the second common flow path 52*c* is on the downstream side. There is a match between the order of the components constituting the circulating flow path 90*c* through which ink flows in the liquid ejecting head 26*c* in the third embodiment and the order of the components constituting the circulating flow path 90 through which ink flows in the liquid ejecting head 26 in the first embodiment.

The vibration absorbing body 54*c* is a film in a planar form that eliminates changes in pressure. The vibration absorbing body 54*c* is disposed in space in which the second liquid chamber 58 in the case 48 is formed, so as to divide the space into a void 49 and the second liquid chamber 58. The void 49 is space formed inside the liquid ejecting head 26*c*. That is, the second liquid chamber 58 is formed on the same side as one surface of the vibration absorbing body 54*c* and the void 49 is formed on the same side as another surface. In this embodiment, part of the case 48, the part including the void 49 on the same side as the other surface of the vibration absorbing body 54*c*, doubles as the cover 80*c*.

Thus, the other surface of the vibration absorbing body 54*c* forms an inner wall of the circulating flow path 90*c* in a direction opposite to the Z direction, in which the nozzles Nz eject ink, the inner wall being an inner wall of the second liquid chamber 58 on the downstream side of the communication paths 63, the second liquid chamber 58 being a flow path having internal pressure lower than the internal pressure in the communication path 63 when ink is circulated in circulating flow path 90*c*. This makes it easy for the vibration absorbing body 54*c* to deform toward the second liquid chamber 58. Therefore, the void 49 formed opposite to the flow path side of the vibration absorbing body 54*c* to deform the vibration absorbing body 54*c* can be made small and the liquid ejecting head 26*c* can thereby be downsized. Therefore, it is possible to implement the liquid ejecting head 26*c* having the vibration absorbing bodies 54*c* and nozzle plate 50*c* without enlarging the apparatus. Furthermore, in the liquid ejecting head 26*c*, the whole of the lower surface Fb of the first flow path substrate 31 is covered with the nozzle plates 50*c*, so the structure of the apparatus can be simplified.

D. Fourth Embodiment

Figure 7:
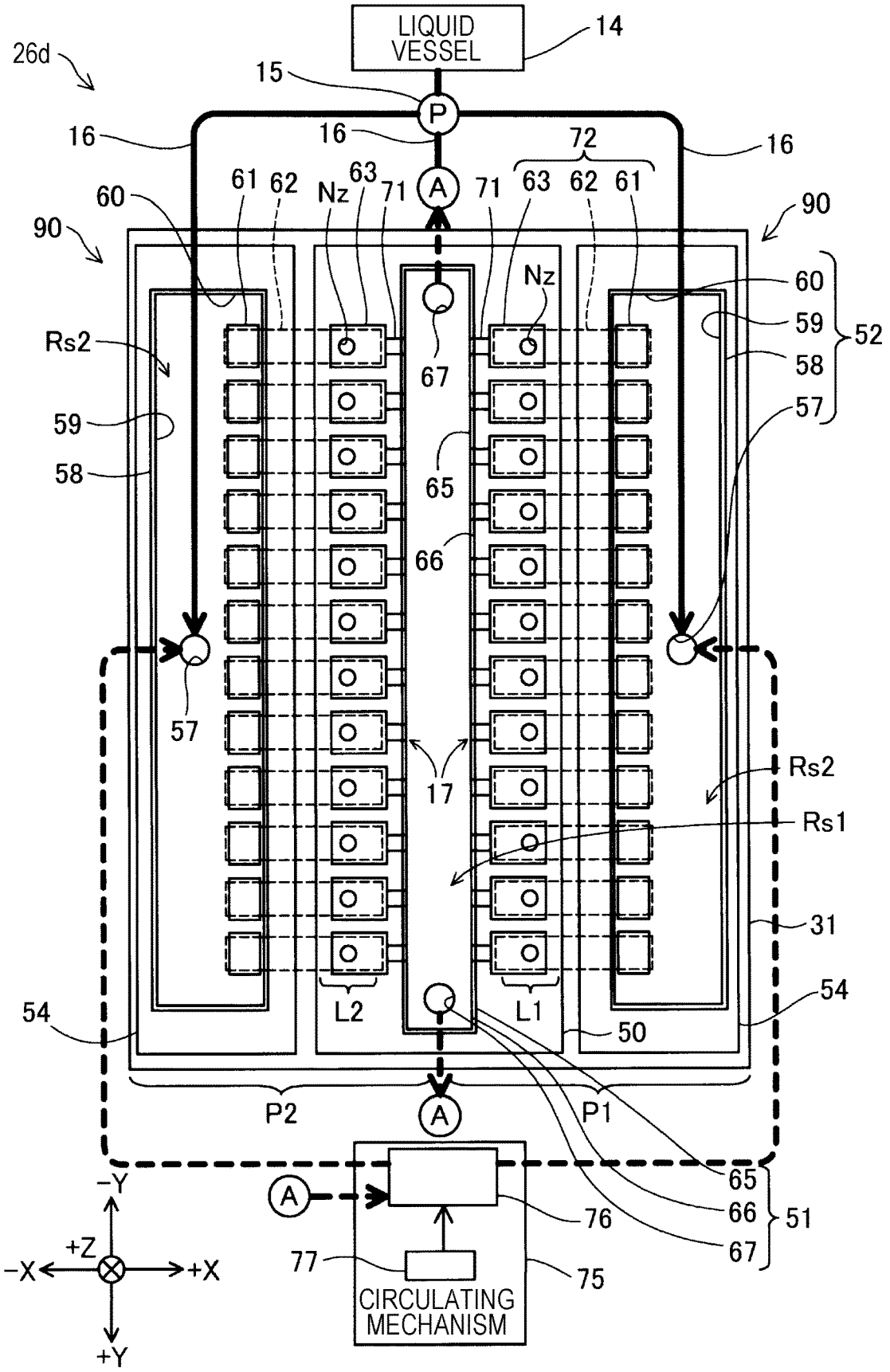
FIG. 7 schematically illustrates ink paths in a plan view of a liquid ejecting head in a fourth embodiment.

FIG. 7 schematically illustrates ink paths in a plan view of a liquid ejecting head 26*d* in a fourth embodiment. For easy understanding of the technology, members that would not be visible due to members located on the front side (Z direction) of the drawing sheet are also illustrated in FIG. 7. The liquid ejecting head 26*d* in the fourth embedment differs from the liquid ejecting head 26 in the first embodiment in the direction in which ink flows. Other respects of the liquid ejecting head 26*d* in the fourth embodiment are similar to the relevant aspects of the liquid ejecting head 26 in the first embodiment.

The arrows indicated in FIG. 7 schematically represent directions, in this embodiment, in which ink flows. More specifically, the ink stored in the liquid vessel 14 and the ink stored in the ink storage tank 76 are fed under pressure to the second circulation port 57 in the second common flow path 52 in the first portion P1 and second portion P2. The ink supplied to the second common flow path 52 is distributed to the supply path 61 in each second individual flow path 72 in the individual flow path group 17. The ink supplied to the second individual flow path 72 passes through the communication path 63 and is ejected from the nozzle Nz to the outside or is supplied to the first individual flow path 71 connected to the second individual flow path 72. The ink supplied to the first individual flow path 71 is fed to the ink storage tank 76 through the first circulation port 67 in the first common flow path 51.

In the liquid ejecting head 26*d* in this embodiment, ink supplied to each second common flow path 52 is distributed to the second individual flow paths 72 in the first portion P1 or second portion P2, whichever is appropriate, after which the ink passes through the individual flow path group 17 and first common flow path 51 and reaches the circulating mechanism 75. The ink that has reached the circulating mechanism 75 is supplied to each second common flow path 52 again. As described above, the liquid ejecting head 26*d* in this embodiment circulates ink with two circulating flow paths 90 and the circulating mechanism 75 in a flow direction opposite to the flow direction in the liquid ejecting head 26 in the first embodiment. That is, in the circulating flow path 90 in the liquid ejecting head 26*d* in this embodiment, the first common flow path 51 is on the downstream side of the ink flow paths and the second common flow path 52 is on the upstream side. The first individual flow path 71 has internal pressure lower than the internal pressure in the communication path 63.

A force with which ink is fed under pressure is applied to the ink by the piezoelectric element 44. The value of a ratio between this force and the acceleration of ink that is caused by the force (the ratio is also referred to as inertance) affects the liquidity of ink. If inertance is large, the liquidity of ink becomes small. If inertance is small, the liquidity of ink becomes high. The magnitude of inertance is stipulated by the density of ink and the length and shape of a flow path. Specifically, inertance M is represented by the equation $M=(\rho L)/S$, where $\rho$ is ink density, L is the length of a flow path, and S is the cross-sectional area of the flow path. If the cross-sectional area of the flow path changes in the longitudinal direction of the flow path, the above equation can be integrated in the longitudinal direction to obtain the inertance of the flow path. The ink density $\rho$ is constant independently of the shape of the flow path, so the magnitude of inertance can be adjusted with the shape of the flow path filled with ink, that is, the length L and cross-sectional area S, and a relationship in the magnitude of inertance can be set among flow paths. In the description below, therefore, inertance will also be referred to as flow path inertance.

In this embodiment, each first individual flow path 71 and the first common flow path 51 are connected together at the position Ed1, which is an end of the nozzle plate 50 on the same side as the inner wall, the wall surface being part of the wall surface Wl of the first common flow path 51. The supply path 61 in the second individual flow path 72 and the to-be-supplied liquid chamber 60 in the second common flow path 52 are connected together at the position Ed2 on a plane along the wall surface, of the to-be-supplied liquid chamber 60, that faces the vibration absorbing body 54 (see FIG. 3).

In the liquid ejecting head 26*d* in this embodiment, the flow path shape of the first individual flow path 71 is set so that the inertance of the first individual flow path 71 is larger than the sum of about half of the inertance of the pressure chamber 62 and the inertance of the supply path 61. Thus, much more liquid flows in the second common flow path 52, which is part of the circulating flow path 90 and from which ink is supplied, the vibration absorbing body 54 being disposed on the same side as the second common flow path 52. This makes it possible to have the vibration absorbing body 54 reduce vibration of pressure waves generated when liquid is expelled and to suppress the problem that pressure generated in the pressure chamber 62 varies (the problem is also referred to as crosstalk), which would otherwise be caused by interference between oscillatory waves in the pressure chamber 62 and pressure vibration in the common flow path, when compared with an aspect in which the inertance of the first individual flow path 71 is smaller than the sum of about half of the inertance of the pressure chamber 62 and the inertance of the supply path 61.

E. Other Embodiments

E1 In the embodiments described above, the liquid ejecting head 26 has the cover 80. However, a liquid ejecting head may lack a cover. Even in this aspect, a vibration absorbing body can be protected from a contact with an object outside the liquid ejecting head by a cover. The cover may be, for example, a mesh-like cover or may cover only part of the vibration absorbing body. Even in this aspect, it is possible to implement a liquid ejecting head that has vibration absorbing bodies and a nozzle plate without enlarging the apparatus.

E2 In the embodiments described above, one surface of the vibration absorbing body 54 forms an inner wall of the circulating flow path 90 having internal pressure lower than the barometric pressure outside the outer walls of the nozzle plate 50 when ink is circulated in the circulating flow path 90. However, one surface of a vibration absorbing body may form an inner wall of the circulating flow path having internal pressure higher than the barometric pressure outside the outer walls of a nozzle plate when ink is circulated in the circulating flow path. Even in this aspect, it is possible to implement a liquid ejecting head that has vibration absorbing bodies and a nozzle plate without enlarging the apparatus.

E3 In the embodiments described above, the vibration absorbing body 54 forms an inner wall located downstream of the communication path 63 and the nozzle plate 50 forms an inner wall located upstream of the communication path 63. However, a vibration absorbing body may form an inner wall located upstream of a communication path and a nozzle plate may form an inner wall located downstream of the communication path. Even in this aspect, it is possible to implement a liquid ejecting head that has vibration absorbing bodies and a nozzle plate without enlarging the apparatus.

E4 In the liquid ejecting head 26*d* in the fourth embodiment described above, the flow path shape of the first individual flow path 71 is set so that the inertance of the first individual flow path 71 is larger than the sum of about half of the inertance of the pressure chamber 62 and the inertance of the supply path 61. However, the flow path shape of a first individual flow path may be set so that the inertance of the first individual flow path is equal to or smaller than the sum of about half of the inertance of a pressure chamber and the inertance of a supply path. Even in this aspect, it is possible to implement a liquid ejecting head that has vibration absorbing bodies and a nozzle plate without enlarging the apparatus.

E5 In the embodiments described above, the vibration absorbing body 54 forms an inner wall of the second common flow path 52 located downstream of the communication path 63. However, a vibration absorbing body may be disposed in a first common flow path and may form an inner wall of any one of the first common flow path and a second common flow path. Even in this aspect, it is possible to implement a liquid ejecting head that has vibration absorbing bodies and a nozzle plate without enlarging the apparatus.

E6 In the embodiments described above, each first individual flow path 71 and the first common flow path 51 are connected directly to the first common flow path 51 on a wall surface at the position Ed1, which is an end of the nozzle plate 50 on the same side as the inner wall, the wall surface being part of the wall surface Wl of the first common flow path 51. However, a first individual flow path and a first common flow path may be connected together at a position distant from a wall surface of the first common flow path toward a nozzle. Even in this aspect, it is possible to implement a liquid ejecting head that has vibration absorbing bodies and a nozzle plate without enlarging the apparatus.

E7 In the embodiments described above, one surface of the nozzle plate 50 forms inner walls of the first individual flow path 71 and first common flow path 51 in the circulating flow path 90. However, one surface of a nozzle plate may form inner walls of a second individual flow path and a second common flow path. Even in this aspect, it is possible to implement a liquid ejecting head that has vibration absorbing bodies and a nozzle plate without enlarging the apparatus.

E8 In the embodiments described above, each first individual flow path 71 and the first common flow path 51 are connected together on a wall surface at the position Ed1, which is an end of the nozzle plate 50 on the same side as the inner wall, the wall surface being part of the wall surface Wl of the first common flow path 51. However, each first individual flow path and a first common flow path may not be connected together on a wall surface at an end of a nozzle plate, the wall surface being part of the wall surfaces of the first common flow path, as when, for example, each first individual flow path and a first common flow path are connected together at a position distant from a wall surface of the first common flow path toward the nozzle. Even in this aspect, it is possible to implement a liquid ejecting head that has vibration absorbing bodies and a nozzle plate without enlarging the apparatus.

E9 In the first embodiment described above, the liquid ejecting head 26 has used a structure in which one first common flow path 51 is provided for two individual flow path groups 17 and the two individual flow path groups 17 share the first common flow path 51. However, one first common flow path may be provided for each individual flow path group. Also, in the first embodiment described above, the two individual flow path groups 17 are disposed so that each individual flow path 70 faces the first common flow path 51. However, individual flow paths on one side and individual flow paths on the other side with the first common flow path intervening between these sides may be mutually shifted by about a half pitch in the Y direction. In this case, in two individual flow path groups, individual flow paths and nozzles provided there are placed in a staggered state. Accordingly, it is possible to increase the nozzle resolution of a head in the Y direction to double the nozzle resolution for one individual flow path group. This is also true for the second embodiment.

E10 In the second embodiment described above as well, relationships among the second common flow path 52*b*, first common flow path 51*b*, individual flow path group 17 in the liquid ejecting head 26*b*, and the like and a shift of about a half pitch between the two individual flow path groups 17 in the Y direction can be handled similarly as in the first embodiment.

E11 the embodiments described above, the flow path forming member 30 includes one first flow path substrate 31. However, a first flow path substrate may have a structure in which, for example, two substrates in each of which flow paths are formed are laminated or a structure in which three or more flow path substrates are laminated. In this aspect, flow paths can be more easily formed in flow path substrates.

F. Other Aspects

The invention is not limited to the embodiments described above; the invention can be implemented in many variations without departing from the intended scope of the invention. For example, the invention can be implemented in aspects below. Technical features, in the above embodiments, corresponding to technical features in the aspects described below can be appropriately replaced or combined to solve part or all of the problems in the invention or achieve part or all of the effects of the invention. If these technical features are not described in this description as being essential, the technical features can be appropriately deleted.

(1) According to an aspect of the invention, a liquid ejecting head that ejects a liquid to the outside is provided. This liquid ejecting head has: a nozzle plate on which nozzles that eject the liquid are formed; a pressure generating section that causes the liquid to be ejected from the nozzles, the pressure generating section being disposed in a pressure chamber communicating with a communication path in which the nozzles are placed; a common flow path through which the liquid is supplied to and discharged from the communication path and pressure chamber; a flow mechanism that moves the liquid supplied to and discharged from the common flow path so as to pass through a flow path that includes the pressure chamber and communication path; and a vibration absorbing body in a planar form that eliminates changes in pressure in the common flow path. The vibration absorbing body is placed at a position at which one surface of the vibration absorbing body forms part of an inner wall of the common flow path and another surface of the vibration absorbing body forms part of an outer wall of the liquid ejecting head. The nozzle plate is placed at a position at which one surface of the nozzle plate forms part of an inner wall of the common flow path at a position different from the position at which the vibration absorbing body is placed and another surface of the nozzle plate forms part of an outer wall of the liquid ejecting head. In the liquid ejecting head in this aspect, the vibration absorbing body and nozzle plate form inner walls of a circulating flow path and an external surface of the liquid ejecting head. Thus, in a liquid ejecting head having the circulating flow path, the number of component parts can be reduced when compared with an aspect in which an outer wall and inner walls of the liquid ejecting head are formed by members other than the vibration absorbing body and nozzle plate. Therefore, it is possible to implement a liquid ejecting head that has vibration absorbing bodies and a nozzle plate without enlarging the apparatus.

(2) According to another aspect of the invention, a liquid ejecting head that ejects a liquid to the outside is provided. This liquid ejecting head has: a nozzle plate on which nozzles that eject the liquid are formed; a pressure generating section that causes the liquid to be ejected from the nozzles, the pressure generating section being disposed in a pressure chamber communicating with a communication path in which the nozzles are placed; a common flow path through which the liquid is supplied to and discharged from the communication path and pressure chamber; a flow mechanism that moves the liquid supplied to and discharged from the common flow path so as to pass through a flow path that includes the pressure chamber and communication path; and a vibration absorbing body in a planar form that eliminates changes in pressure in the common flow path. The vibration absorbing body is placed at a position at which one surface of the vibration absorbing body forms part of an inner wall of the common flow path and another surface of the vibration absorbing body forms a void in the liquid ejecting head. The nozzle plate is placed at a position at which one surface of the nozzle plate forms part of an inner wall of the common flow path at a position different from the position at which the vibration absorbing body is placed and another surface of the nozzle plate forms part of an outer wall of the liquid ejecting head. This makes it easy for the vibration absorbing body to deform toward the flow path. Accordingly, a void formed opposite to the flow path side of the vibration absorbing body to deform the vibration absorbing body can be made small. Therefore, it is possible to implement a liquid ejecting head that has vibration absorbing bodies and a nozzle plate without enlarging the apparatus.

(3) In the liquid ejecting head in the above embodiments, the one surface of the vibration absorbing body may form the inner wall of the flow path at a location at which the flow path has internal pressure lower than the barometric pressure on the same side as the outer wall of the nozzle plate when the liquid flows in the flow path. In the liquid ejecting head in this aspect, the vibration absorbing body forms an inner wall of a circulating flow path having internal pressure lower than the barometric pressure outside the liquid ejecting head. This makes it easy for the vibration absorbing body to deform toward the interior of the circulating flow path.

(4) In the liquid ejecting head in the above embodiments, the one surface of the vibration absorbing body may form the inner wall of the flow path at a location at which the flow path has internal pressure lower than the internal pressure in the communication path when the liquid flows in the flow path. The one surface of the nozzle plate may form the inner wall of the flow path at a location at which the flow path has internal pressure higher than the internal pressure in the communication path when the liquid flows in the flow path. In the liquid ejecting head in this aspect, the vibration absorbing body is disposed at a location, in a circulating flow path, at which its internal pressure is lower than the internal pressure in the communication path. Accordingly, it is possible to restrain the vibration absorbing body from being deformed toward the outside of the liquid ejecting head and thereby to downsize the apparatus when compared with an aspect in which the vibration absorbing body is disposed at a location, in a communication flow path, at which its internal pressure is higher than the internal pressure in the communication path.

(5) In the liquid ejecting head in the above aspects, the common flow path may include a first common flow path through which the liquid is supplied and a second common flow path that accepts the liquid that has passed through the communication path and the pressure chamber. The communication path and the pressure chamber may form part of a plurality of individual flow paths that connect the first common flow path and the second common flow path together. In the liquid ejecting head in this aspect, a plurality of individual flow paths each of which has a nozzle are provided. Therefore, the number of nozzles that can be provided in one liquid ejecting head can be increased.

(6) In the liquid ejecting head in the above aspects, the vibration absorbing body may form only part of the inner wall of any one of the first common flow path and the second common flow path. At portions at which a common flow path and an individual flow path group are connected together, a flow path shape changes. If the vibration absorbing body comes into contact with these connection portions, therefore, the vibration absorbing body may be damaged. In the liquid ejecting head in this aspect, the vibration absorbing body is disposed so as to form an inner wall of any one of the first common flow path and the second common flow path. That is, the vibration absorbing body forms only an inner wall of a common flow path. Therefore, it is possible to suppress that the problem that a contact occurs between a vibration absorbing body and a connection portion between a common flow path and an individual flow path.

(7) In the liquid ejecting head in the above aspects, each of the plurality of individual flow paths may include a first individual flow path that connects the communication path and the first common flow path together and a second individual flow path that includes the communication path and the pressure chamber and connects the communication path and the second common flow path together. Part of the first individual flow path is formed by the inner wall of the nozzle plate. In the liquid ejecting head in this aspect, part of the first individual flow path is formed along a wall surface of the nozzle plate. Thus, the nozzle and the first individual flow path come close to each other when compared with an aspect in which the first individual flow path is not structured along a wall surface of the nozzle plate. This makes it easy to lead the liquid in the vicinity of the nozzle to the first individual flow path. This can promote circulation of the liquid in the vicinity of the nozzle.

(8) In the liquid ejecting head in the above aspects, a supply path may be provided that connects the pressure chamber and the second common flow path together. The inertance of the first individual flow path may be larger than the sum of half of the inertance of the pressure chamber and the inertance of the supply path. In the liquid ejecting head in this aspect, if the first individual flow path is on the downstream side of the circulating flow path in a liquid flow direction, inertance at a position at which the first individual flow path and first common flow path are connected together is larger than inertance at a position at which the second individual flow path and second common flow path are connected together. Thus, much more liquid flows in the second individual flow path and second common flow path, which are part of the circulating flow path and from which liquid is supplied, the vibration absorbing body being disposed on the same side as the second individual flow path second common flow path. This makes it possible to suppress crosstalk in which the amplitudes of a vibration waveform in the pressure chamber and a vibration waveform generated by a flow of a liquid are increased when compared with an aspect in which inertance at a position at which the first individual flow path and first common flow path are connected together is smaller than inertance at a position at which the second individual flow path and second common flow path are connected together.

(9) In the liquid ejecting head in the above aspects, part of the inner walls of the first individual flow path and first common flow path may be formed by the nozzle plate. In the liquid ejecting head in this aspect, the first individual flow path formed along the wall surface of the nozzle plate is connected to the first common flow path at a position on the wall surface of the nozzle plate. This makes it easy to lead liquid supplied from the first common flow path to the first individual flow path along the nozzle plate. This promotes circulation of the liquid in the circulating flow path.

(10) In the liquid ejecting head in the above aspects, the first individual flow path may be connected directly to the first common flow path at a position in the first common flow path, the position being on the inner wall of the nozzle plate. In the liquid ejecting head in this aspect, the position at which the first individual flow path and first common flow path are connected together is on the wall surface of the first common flow path in the flow direction. This makes it easy to evenly supply liquid to a plurality of individual flow paths when compared with, for example, an aspect in which the first individual flow path and first common flow path are connected together at a position distant from the wall surface of the first common flow path toward the nozzle.

(11) The liquid ejecting head in the above aspects may have a circulating flow path in which the second common flow path is connected to the first common flow path through an individual flow path group including the plurality of individual flow paths; the circulating flow path may be one of two circulating flow paths in which two second common flow paths are connected to one first common flow path through two individual flow path groups. In the liquid ejecting head in this aspect, two circulating flow paths, each of which includes a plurality of nozzles, are provided. Therefore, the number of nozzles that can be provided in one liquid ejecting head can be further increased.

(12) The liquid ejecting head in the above aspects may have a circulating flow path in which the first common flow path is connected to the second common flow path through an individual flow path group including the plurality of individual flow paths; the circulating flow path may be one of two circulating flow paths in which two first common flow paths are connected to one second common flow path through two individual flow path groups. In the liquid ejecting head in this aspect, two circulating flow paths, each of which includes a plurality of nozzles, are provided. Therefore, the number of nozzles that can be provided in one liquid ejecting head can be further increased.

(13) The liquid ejecting head in the above aspects may further have a cover that protects the other surface of the vibration absorbing body. In the liquid ejecting head in this aspect, a cover is provided that protects the vibration absorbing body on the same side as an outer wall of the liquid ejecting head. Therefore, the vibration absorbing body is protected from a contact with an object outside the liquid ejecting head by the cover.

The invention is not limited to a liquid ejecting apparatus that ejects an ink; the invention can also be applied to a liquid ejecting apparatus that ejects another liquid other than inks. The invention can be applied to various types of liquid ejecting apparatuses. The invention can be implemented in the form of, for example, an image recording apparatus such as a facsimile machine, a color material ejecting apparatus used in the manufacturing of color filters for image display apparatuses such as liquid crystal displays, an electrode material ejecting apparatus used to form electrodes in organic electroluminescence (EL) displays, field emission displays (FEDs), and the like, a liquid electing apparatus that ejects a liquid including bio-organic substances used in the manufacturing of biochips, a sample ejecting apparatus used as a precise pipette, a lubricant ejecting apparatus, a resin solution ejecting apparatus, a liquid ejecting apparatus that ejects a lubricant to a clock, a camera, or another precision machine at a particular point, a liquid ejecting apparatus that ejects a transparent resin solution such as an ultraviolet curable resin solution to a substrate to form a minute hemispherical lens (optical lens) or the like used in an optical communication element or the like, a liquid ejecting apparatus that ejects an acidic or alkaline etching solution to etch a substrate or the like, and a liquid ejecting apparatus having a liquid ejecting head that ejects a very small amount of any other droplets.

The present application is based on, and claims priority from JP Application Serial Number 2018-056079, filed Mar. 23, 2018, the disclosure of which is hereby incorporated by reference herein in its entirety.

What is claimed is:

1. A liquid ejecting head for ejecting a liquid to an outside, the head comprising:

a nozzle plate on which a nozzle for ejecting the liquid is formed;

a pressure generating section configured to cause the liquid to be ejected from the nozzle, the pressure generating section being disposed corresponding to a pressure chamber communicating with a communication path comprising the nozzle;

a common flow path through which the liquid is supplied to and discharged from the communication path and the pressure chamber; and a vibration absorbing body configured to eliminate a change in pressure in the common flow path; wherein the vibration absorbing body is placed at a position at which one surface of the vibration absorbing body forms part of an inner wall of the common flow path, and another surface of the vibration absorbing body forms part of an outer wall of the liquid ejecting head, and the nozzle plate is placed at a position at which one surface of the nozzle plate forms part of an inner wall of the common flow path at a position different from the position at which the vibration absorbing body is placed, and another surface of the nozzle plate forms part of an outer wall of the liquid ejecting head.

2. The liquid ejecting head according to claim 1, wherein the one surface of the vibration absorbing body forms the inner wall of the flow path at a location at which the flow path has internal pressure lower than barometric pressure on the same side as an outer wall of the nozzle plate when the liquid flows in the flow path.

3. The liquid ejecting head according to claim 1, wherein:

the one surface of the vibration absorbing body forms the inner wall of the flow path at a location at which the flow path has internal pressure lower than internal pressure in the communication path when the liquid flows in the flow path; and the one surface of the nozzle plate forms the inner wall of the flow path at a location at which the flow path has internal pressure higher than the internal pressure in the communication path when the liquid flows in the flow path.

4. The liquid ejecting head according to claim 1, wherein:

the common flow path includes a first common flow path through which the liquid is supplied and a second common flow path that accepts the liquid that has passed through the communication path and the pressure chamber; and the communication path and the pressure chamber form part of a plurality of individual flow paths that connect the first common flow path and the second common flow path together.

5. The liquid ejecting head according to claim 4, wherein the vibration absorbing body forms only part of the inner wall of any one of the first common flow path and the second common flow path.

6. The liquid ejecting head according to claim 4, wherein:

each of the plurality of individual flow paths includes a first individual flow path that connects the communication path and the first common flow path together, and a second individual flow path that includes the communication path and the pressure chamber and connects the communication path and the second common flow path together; and part of the first individual flow path is formed by the inner wall of the nozzle plate.

7. The liquid ejecting head according to claim 6, further comprising a supply path that connects the pressure chamber and the second common flow path together, wherein inertance of the first individual flow path is larger than a sum of half of inertance of the pressure chamber and inertance of the supply path.

8. The liquid ejecting head according to claim 7, wherein part of the inner wall of the first individual flow path and the inner wall of the first common flow path is formed by the nozzle plate.

9. The liquid ejecting head according to claim 8, wherein the first individual flow path is connected directly to the first common flow path at a position in the first common flow path, the position being on the inner wall of the nozzle plate.

10. The liquid ejecting head according to claim 4, further comprising a circulating flow path in which the second common flow path is connected to the first common flow path through an individual flow path group including the plurality of individual flow paths, wherein the circulating flow path is one of two circulating flow paths in which two second common flow paths are connected to one first common flow path through two individual flow path groups.

11. The liquid ejecting head according to claim 4, further comprising a circulating flow path in which the first common flow path is connected to the second common flow path through an individual flow path group including the plurality of individual flow paths, wherein the circulating flow path is one of two circulating flow paths in which two first common flow paths are connected to one second common flow path through two individual flow path groups.

12. The liquid ejecting head according to claim 1, further comprising a cover that protects the another surface of the vibration absorbing body.

13. A liquid ejecting head for ejecting a liquid to an outside, the head comprising:

a nozzle plate on which a nozzle for ejecting the liquid is formed;

a pressure generating section configured to cause the liquid to be ejected from the nozzle, the pressure generating section being disposed corresponding to a pressure chamber communicating with a communication path comprising the nozzle;

a common flow path through which the liquid is supplied to and discharged from the communication path and the pressure chamber; and a vibration absorbing body configured to eliminate a change in pressure in the common flow path; wherein the vibration absorbing body is placed at a position at which one surface of the vibration absorbing body forms part of an inner wall of the common flow path, and another surface of the vibration absorbing body forms a void in the liquid ejecting head, and the nozzle plate is placed at a position at which one surface of the nozzle plate forms part of an inner wall of the common flow path at a position different from the position at which the vibration absorbing body is placed, and another surface of the nozzle plate forms part of an outer wall of the liquid ejecting head.

14. The liquid ejecting head according to claim 13, wherein the one surface of the vibration absorbing body forms the inner wall of the flow path at a location at which the flow path has internal pressure lower than barometric pressure on the same side as an outer wall of the nozzle plate when the liquid flows in the flow path.

15. The liquid ejecting head according to claim 13, wherein:

the one surface of the vibration absorbing body forms the inner wall of the flow path at a location at which the flow path has internal pressure lower than internal pressure in the communication path when the liquid flows in the flow path; and the one surface of the nozzle plate forms the inner wall of the flow path at a location at which the flow path has internal pressure higher than the internal pressure in the communication path when the liquid flows in the flow path.

16. The liquid ejecting head according to claim 13, wherein:

the common flow path includes a first common flow path through which the liquid is supplied and a second common flow path that accepts the liquid that has passed through the communication path and the pressure chamber; and the communication path and the pressure chamber form part of a plurality of individual flow paths that connect the first common flow path and the second common flow path together.

17. The liquid ejecting head according to claim 16, wherein the vibration absorbing body forms only part of the inner wall of any one of the first common flow path and the second common flow path.

18. The liquid ejecting head according to claim 16, wherein:

each of the plurality of individual flow paths includes a first individual flow path that connects the communication path and the first common flow path together, and a second individual flow path that includes the communication path and the pressure chamber and connects the communication path and the second common flow path together; and part of the first individual flow path is formed by the inner wall of the nozzle plate.

19. The liquid ejecting head according to claim 18, further comprising a supply path that connects the pressure chamber and the second common flow path together, wherein inertance of the first individual flow path is larger than a sum of half of inertance of the pressure chamber and inertance of the supply path.

20. The liquid ejecting head according to claim 19, wherein part of the inner wall of the first individual flow path and the inner wall of the first common flow path is formed by the nozzle plate.

* * * * *